US005169249A

United States Patent [19]

Kitabata

[11] Patent Number: 5,169,249

[45] Date of Patent: Dec. 8, 1992

[54] PRINTER CONTROL DEVICE AND METHOD THEREOF

[76] Inventor: Kazuo Kitabata, 3-5, Owa 3-chome, Suwa-shi, Nagano-ken, Japan

[21] Appl. No.: 520,430

[22] Filed: May 8, 1990

Related U.S. Application Data

[63] Continuation-in-part of Ser. No. 448,449, Dec. 11, 1989, abandoned, which is a continuation-in-part of Ser. No. 439,129, Nov. 17, 1989, Pat. No. 5,128,858.

[30] Foreign Application Priority Data

May 16, 1989 [JP] Japan ..... 1-122506

[51] Int. Cl.[5] ..... B41J 11/42

[52] U.S. Cl. ..... 400/582; 400/706

[58] Field of Search ..... 400/64, 706, 708, 582

[56] References Cited

U.S. PATENT DOCUMENTS 4,671,683 6/1987 Ueno ..... 400/708

4,934,845 6/1990 Kato ..... 400/708

*Primary Examiner*—David A. Wiecking

*Assistant Examiner*—Steven S. Kelley

[57] ABSTRACT

A control device for a printer includes a detector for detecting the presence and absence of paper within that portion of the printer immediately preceding a platen. When the detector detects the first absence of paper the control device determines how much longer to continue driving the printer to record printable matter on the page. The control device makes this determination based on other than the detected presence of the next piece of paper within the printer.

10 Claims, 4 Drawing Sheets

PRINTER CONTROL DEVICE AND METHOD THEREOF

CROSS-REFERENCE TO RELATED APPLICATIONS

This application is a continuation-in-part of U.S. Pat. application Ser. No. 07/448,449, filed Dec. 11, 1989, now abandoned, which is a continuation-in-part of U.S. Pat. application Ser. No. 07/439,129, filed Nov. 17, 1989, now U.S. Pat. No. 5,128,858.

BACKGROUND OF THE INVENTION

The present invention relates generally to a system for controlling the operation of a printer, and more particularly, to a system for controlling the operation of a printer when end of a piece of paper approaching the platen of the printer is first detected.

Conventional printers include paper detectors for determining when printable matter can be recorded on the paper. The detector provides two different outputs corresponding to the presence and absence of paper. When the trailing edge of the paper is detected by the paper detector, the detector's output changes to indicate the absence of paper. When the leading edge of the paper is detected by the paper detector, the detector's output changes to indicate the detected presence of the paper.

The detector is typically disposed behind a print head so that as the paper advances through the printer the paper passes by the paper detector before reaching the print head. When the absence of paper is first detected, that portion of the paper between the print head and paper detector (hereinafter referred to as an override amount L) remains to be advanced beyond the print head. To permit printing of printable matter on a override amount L, conventional printers continuously monitor the output of the paper detector for continuous indication of paper absence. Printing on override amount L continues until a maximum line count, corresponding to the maximum amount of printable matter, within override amount L is reached.

The printer considers that the next piece of paper is set for printing when the presence of paper is once again detected by the paper detector. When the next piece of paper is detected, print control action for the last piece of paper is terminated and ejection of the last piece of paper is initiated by the printer.

The paper detector generally includes either a microswitch or phototransistor. The microswitch is actuated by the weight of the paper. The phototransistor unit is actuated light is interrupted. The output of the paper detector tends to include chatter (i.e. noise) caused by the vibration of the paper, printer or surrounding conditions. Such chatter during printing of override amount L can be erroneously interpreted by the printer as representing the detected presence of paper. Printing of less than all of the printable matter within override amount L results. Undesirable variations in the bottom margin of each printed page also occurs.

Accordingly, it is desirable to provide a printer control device and method which maximizes the amount of printable matter recorded on a page by preventing the premature termination of recording printable matter within override amount L.

SUMMARY OF THE INVENTION

Generally speaking, in accordance with the invention, a printer includes a printing device, a feeding device for advancing a recording medium therethrough and a detecting device for detecting the presence and absence of the recording medium. Upon the absence of the recording medium being detected by the detecting device, a remaining portion of the recording medium remains to be advanced beyond the printing device.

The printer also includes a control device which includes a judging device for determining the existence of region within the remaining portion of the recording medium on which printable matter can be recorded. The determination is based on the remaining portion to be advanced by the feeding device and the length of the remaining printable area of the remaining portion. The length is in the direction of advancement of the recording medium. The printer further includes feed control circuitry for controlling the operation of the feeding device and printing control circuitry for controlling the operation of the printing device.

Both the feed control circuitry and print control circuitry are responsive to instructions from the judging device which are based on other than the detected presence subsequent to the detected absence of the recording medium by the detecting device. An erroneous indication by the detecting device of the presence of the next piece of recording medium will not prematurely terminate operation of the printing device or feeding device when recording printable matte within the remaining portion of the recording medium. Printing of all printable matter within the override amount L results.

The printing device includes a print head and a path along which the recording medium advances through the printer. The detecting device and print head are disposed relative to one another such that the recording medium advances past the detecting device prior to reaching the print head.

In accordance with one embodiment of the invention, the control device also includes storage means for storing a decremented value representing the region within the remaining portion of the recording medium on which printable matter can be recorded. The judging device includes subtracting circuitry for reducing the decremented value by a fixed amount corresponding to the distance by which the feeding device advances the remaining portion of the recording medium toward the printing device. Reduction of the decremented value by the fixed amount occurs each time the feeding device advances the remaining portion of the recording medium toward the print head. The judging device in response to the decremented value being zero determines that no further printable matter can be recorded within the remaining portion of the recording medium.

In another embodiment of the invention, the storage means stores an accumulated value representing the region within the remaining portion of the recording medium on which printable matter can be recorded. In this alternative embodiment of the invention, the judging means includes accumulating circuitry for incrementing the accumulated value by a fixed amount corresponding to the distance by which the feeding device advances the remaining portion of the recording medium toward the printing device. The accumulating circuitry increments the accumulated value by the fixed amount each time the feeding device advances he remaining portion of the recording medium. The judging device in response to the accumulated value being at a predetermined maximum value determines that no further printable matter can be recorded within the remaining portion of the recording medium.

Accordingly, it is an object of the invention to provide an improved control device and method for a printer which maximizes the amount of printable matter which can be recorded on a page.

It is another object of the invention to provide an improved control device and method for a printer which prevents the premature termination of recording printable matter on each page.

Still other objects and advantages of the invention will, in part, be obvious and will, in part, be apparent from the specification.

The invention accordingly comprises the several steps and a relation of one or more such steps with respect to each of the others, and the apparatus embodying features of construction, a combination of elements and arrangements of parts which are adapted to effect such steps, all is exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
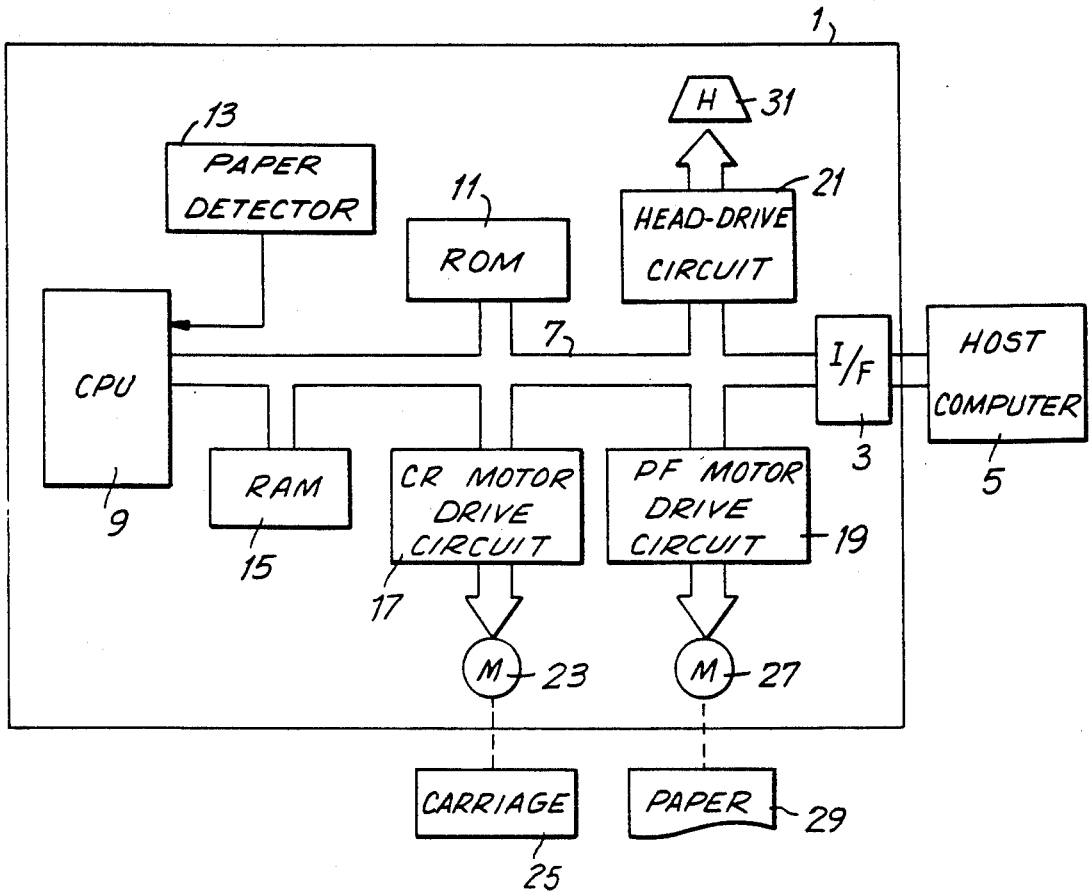
FIG. 1 is a block diagram of a printer control device constructed in accordance with the invention.

As shown in FIG. 1, a printer control device 1 is connected to an external host computer 5 by an interface (I/F) 3. Printer control device 1 includes a central processing unit (CPU) 9 coupled to interface 3 by an address/data bus 7 Bus 7 also couples CPU 9 to a read only memory (ROM) 11 and a random access memory (RAM) 15. A detector 13 detects the presence and absence within a portion of printer 100 of a recording medium such as, but not limited to, paper 29 (shown in FIG. 2).

CPU 9 controls printing by printer 100 in accordance with a plurality of control programs stored in ROM 11. Print data and print control commands for controlling paper feed, carriage movement and other functions are provided by host computer 5. This data is temporarily stored in interface 3 or RAM 15. During execution of print control commands, CPU 9 reads and interprets the data found in interface element 3 and, if necessary, also refers to the output from detector 13 and other data such as, but not limited to, print control stored in ROM 11 or RAM 15. CPU 9 processes the control program based on this foregoing data and produces commands to a carriage (CR) motor driving circuit 17, a paper feed (PF) motor driving circuit 19 and a head driving circuit 21 through address/data bus 7 for controlling each of these circuits.

Figure 2:
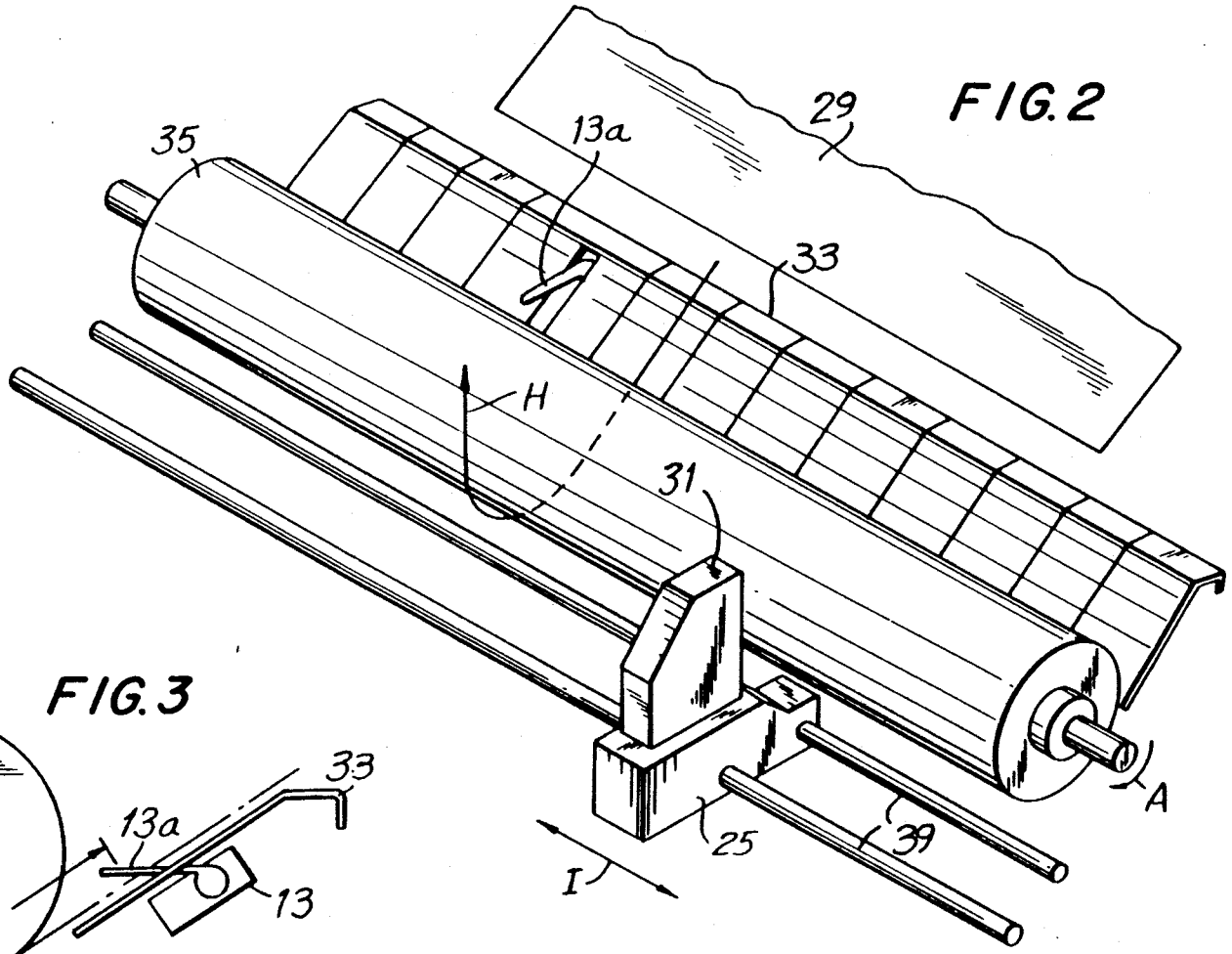
FIG. 2 is a partial perspective view of the printer.
Figure 3:
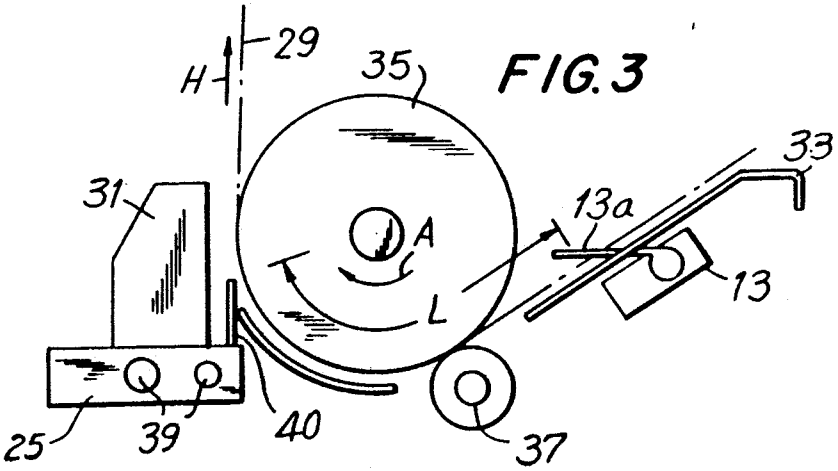
FIG. 3 is a side elevational view of the printer shown in FIG. 2.

CR motor driving circuit 17 drives a carriage (CR) motor 23 in accordance with commands from CPU 9 to move a carriage 25 along guide rods 39 (shown in FIGS. 2 and 3). PF motor driving circuit 19 drives a PF motor 27 for feeding (i.e. advancing) paper 29. CR motor 23 and PF motor 27 are step motors. The number of steps of each motor determines the amount of shift (movement) of carriage 25 and the distance that paper 29 is fed towards a print head 31. Head driving circuit 21 drives print head 31 mounted on carriage 25 to properly position print head 31 relative to paper 29. Printing by print head 31 on page 29 is performed in response to the shifting (movement) of carriage 25. Paper 29 is advanced (i.e., fed) when carriage 25 stops.

RAM 15 stores a non-executed paper feed amount A, a remaining printable amount LL, and a no-paper flag PE. In addition, RAM 15 stores format data including line pitch, character magnifying factors and paper rear edge marginal length. The line pitch data and the rear edge marginal length data are in the form of a step count for PF motor 27. The non-executed paper feed amount A and the remaining printable amount LL are in the form of a line pitch count rather than in the form of a step count As shown in FIGS. 2 and 3, a platen 35 is rotatably mounted within printer 100. Carriage 25 is mounted on guide rods 39 adjacent to platen 35 and performs linear reciprocal movement in the direction of a pair of arrows I along platen 35. Print head 31 is mounted to carriage 35 in a facing relationship with platen 35. A paper guide 33 is disposed on the opposite side of platen 35 spaced from platen 35 to support and guide paper 29 toward platen 35. A detection pin **13*a* of detector 13 for detecting the presence and absence of paper 29 extends through paper feeding guide 33**.

A paper feeding roller 37 is biased towards and abuts platen 35. As platen 35 rotates in the direction of an arrow A, roller 37 cooperates with platen 35 to feed paper 29 through printer 100 in the direction of an arrow H. Paper 29 advances from paper feeding guide 33 to between platen 35 and paper roller 37 in the direction of arrow H. Guide 33 drops paper 29 between paper roller 37 and platen 35 to feed paper 29 upwardly along the surface of platen 35 towards and in front of print head 31. Platen 35 is rotated in the direction of arrow A by PF motor 27. Feeding of paper 29 is based on the line pitch having a unitized value previously stored in RAM 15. This line pitch is stored in RAM 15 after being converted into a step count of PF motor 27 (i.e., the number of steps PF motor 27 must advance for each line of advancement of paper 29). The actual paper feed amount is specified by the paper feed control command output by host computer 5.

When paper feeding is completed, carriage 25 shifts along guide rods 39 and print head 31 is driven to perform the printing of one line on paper 29. Generally, line printing and paper feeding are alternately repeated.

In accordance with one embodiment of the invention, detector 13 is a microswitch. Detector 13 is positioned on the back side of paper feeding guide 33 so that detection pin **13*a* projects through paper feeding guide 33 within the paper feed path. When paper 29 is present, detection pin 13*a* is depressed by the weight of paper 29. Detector 13 outputs a signal corresponding to the presence of paper 29. When the trailing edge of paper 29 passes detection pin 13*a*, detection pin 13*a* is not longer depressed by the weight of paper 29. The output of detector 13** changes to reflect the absence of paper thereat.

Figure 4:
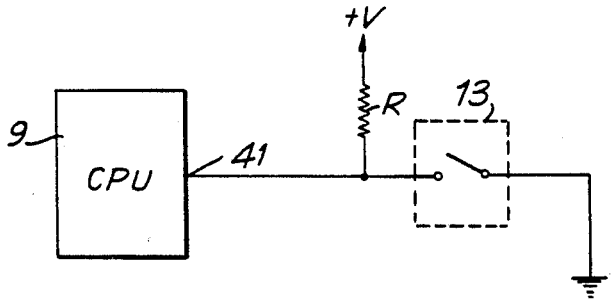
FIG. 4 is a simplified schematic diagram of a paper detector connected to a CPU.

As shown in FIG. 4, paper detector 13 is connected between a DC power source having a voltage level +V and ground. Paper detector 13 provides a low logic level when it is turned ON representing the detected presence of paper and a high logic level when it is turned OFF representing the absence of paper 29 thereat. These logic levels are continuously supplied to CPU 9.

Referring once again to FIG. 3, a printable region within override amount L of paper 29 can exist when no paper flag PE is set (produced). Flag PE is set when the trailing edge of paper 29 has passed detection pin 13*a*. Override amount (length) L corresponds to the distance along paper 29 extending from detection pin 13*a* to a paper retaining plate 40 positioned just head 31. In other words, override amount L has a fixed value dependent on the relative positioning of detector 13 and paper retaining plate 40 an can be converted to a particular number of steps of PF motor 27 and stored either in ROM 11 or RAM 15.

The number of lines which may be printed within the override amount L differs in accordance with the line pitch and bottom marginal length. The data for setting line pitch and bottom margin width together with the data of the number of line characters, intercharacter pitch, character magnification and the like comprise the format data for printing. The number of printable lines (printable line count (i.e. LL)) within override amount L varies based on the line pitch count, character magnifying factor, and bottom marginal length. The format data is input to print control 1 from host computer 5 prior to input of commands for executing a printing operation (i.e., printing data and printing control commands). The format data is transmitted from interface 3 to CPU 9 and then stored in a dedicated area of RAM 15.

Figure 5A:
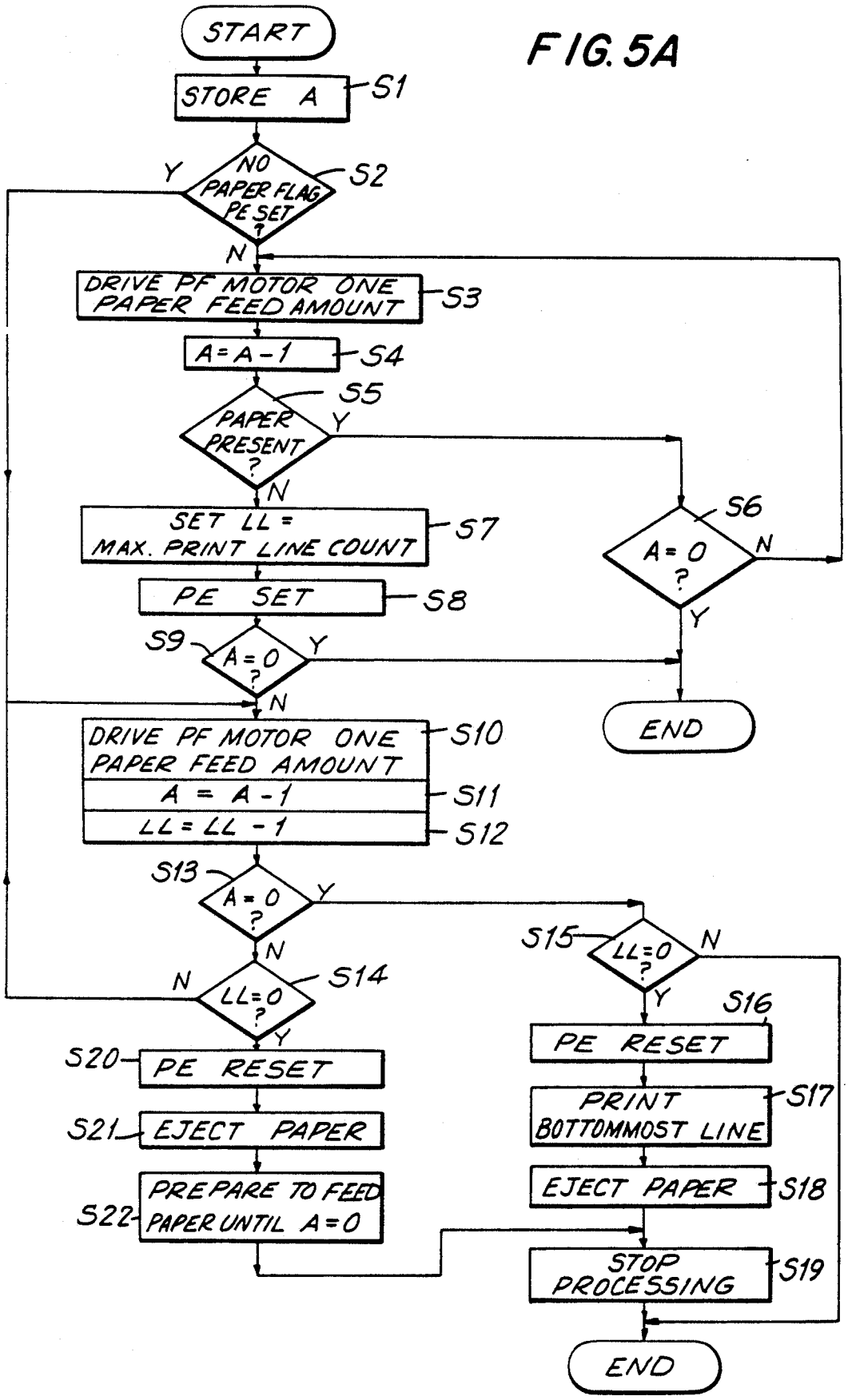
FIGS. 5A and 5B are flow charts illustrating CPU processing in accordance with alternative embodiments of the invention.

FIG. 5A illustrates a processing routine of CPU 9 in accordance with one embodiment of the invention. This routine is performed each time the control command for paper feed is supplied by CPU 9. First, a paper feed amount, indicated by the control command, is stored in RAM 15 as a non-executed paper feed amount A under step 1 (S1). Under step 2 (S2) the routine judges whether detector 13 has detected the presence or absence of paper 13 thereat by checking no-paper flag PE stored in RAM 15. Once no paper flag PE has been set, no-paper flag PE remains set. Erroneous indication due to chatter and the like by paper detector 13 of the next piece of paper 29 does not result in prematurely terminating printing within override amount L and ejection by printer 100 of the current piece of paper 29. The same processing routine (described below) will continue to be repeated provided the total paper feed amount fed through printer 100 does not exceed a maximum printable line count within the override amount L.

When no-paper flag PE is in the set state, both the non-executed paper feed amount A and remaining printable amount LL are checked by CPU 9 to determine when to terminate printing in override amount L and eject paper 29 from printer 100. More particularly, with no paper flag PE in the set state, the processing routine skips from step 2 to step 10 (S10). As described in detail below, beginning with step 10, the processing routine limits further paper feed so as to not exceed the printable line count (remaining printable amount LL).

When no-paper flag PE is in a reset state the routine proceeds from step 2 (S2) to step 3 (S3) in which PF motor 27 is driven by one line pitch (i.e., one unit paper feed amount). One (1) line pitch is subtracted from the non-executed paper feed amount A under step 4 (S4). Paper detector 13 is checked under step 5 (S5). When the presence of recording medium 29 is detected by detector 13, the value of non-executed paper feed amount A is checked to determine whether it has reached zero (0) in step 6. When A is not equal to 0, the processing routine returns to step 3 so that PF motor 27 is driven one more line pitch. Steps 3–6 are repeated each time paper detector 13 detects the presence of paper 29. This portion of the processing routine (steps 3–6) permits paper 29 to be advanced for printing by print head 31 until A=0 or the absence of paper 29 is detected by detector 13. When the non-executed paper feed amount A reaches a value of 0 under step 6, the processing routine ends.

When paper detector 13 first detects the absence of paper under step 5, the maximum printable line count within the override amount L is initialized and set into memory as the remaining printable amount LL in step 7 (S7). When the bottom margin (paper rear edge margin) is smaller than override amount L, the maximum printable line count is equal to override amount L less the length of the bottom margin (i.e.. paper rear edge marginal length). Upon initialization of the remaining printable amount LL, no-paper flag PE is changed from a reset state to a set state in step 8 (S8). Non-executed paper feed amount A is then checked to determine if it is at a value of 0 under step 9 (S9).

Under step 9, when non-executed paper feed amount A is equal to 0, the processing routine ends. When non-executed paper feed amount A is not equal to 0 under step 9, the routine proceeds to step 10 (S10). Under step 10, advancement of paper 29 continues while monitoring remaining printable amount LL. In step 10, PF motor 27 is driven by a one unit paper feed amount (i.e., one line pitch). The now-executed paper feed line count of "1" is subtracted from non-executed paper feed amount A in step 11 (S11) and from remaining printable amount LL in step 12 (S12) Non-executed paper feed amount A is once again checked to determine whether it has reached a value of 0 in step 13 (S13). Under step 14 (S14), when the value of non-executed paper feed amount A is not 0, remaining printable amount LL is checked to determine whether it has reached a value of 0. When remaining printable amount LL is not at a value of 0, a region within remaining printable amount LL exists for printing of additional matter. Consequently, the routine returns to step 10 to advance paper 29 by one more line. This portion of the routine (steps S10–S14) are repeated each time paper 29 is advanced until either non-executed paper feed amount A or remaining printable amount LL has a value of 0.

When non-executed paper amount A is at a value of 0 in step 13, the value of remaining printable amount LL is checked at step 15 (S15). When remaining printable amount LL is at value of 0 no-paper flag PE is reset at step 16 (S16) and printing of the bottommost line of paper 29 occurs under step 17 (S17). Once the printing of the last line (bottommost line) is performed, PF motor 27 is driven to eject paper 29 at step 18 (S18). Print control processing terminates under step 19 (S19) and the routine ends.

In an alternative embodiment, step 18 is omitted so that processing terminates after the printing of the last line of paper 29 under step 18. After the routine ends, a new piece of paper 29 is inserted into printer 100. Print control is restarted upon input of a restarting command from host computer 5.

Under step 15 when the last line of paper 29 has not been reached, remaining printable amount LL is not at a value of 0. Paper feeding is terminated and no-paper flag PE remains in a set position in preparation for successive execution of the print control in accordance with next control command.

When remaining printable amount LL is at a value of 0 under step 14, no-paper flag PE is reset in step 20 (S20). In other words, when the last line of paper 29 is reached prior to the completion of paper feeding, no-paper flag PE is reset. PF motor 27 is driven to eject paper 29 at step 21 (S21). Printer 100 is set in step 22 such that paper 29 can continue to be fed corresponding to non-executed paper feed amount A prior to restarting print control with respect to the next (new) piece of paper 29. Upon completion of paper feeding, processing terminates under step 19. Alternatively, step 21 and step 22 may be omitted such that the processing terminates under step 19 immediately after execution of step 20.

As now can be readily appreciated, the invention eliminates chattering or any other type of noise erroneously being interpreted by paper detector 13 as the presence of the next piece of paper 29 during processing of override amount L . The remaining printable amount (space) LL does not vary for each piece of paper 29. No paper flag PE is set under step 8 when paper detector 13 first detects the absence of paper 29. No-paper flag PE is checked only at step 2. Therefore, once no-paper flag PE is set, paper 29 is advanced under step 10 until the indicated paper, feed amount is obtained at step 13 (i.e., A=0). The paper feeding operation of step 10 is repeated until the last line of paper 29 is reached at step 14 or step 15.

Figure 5B:
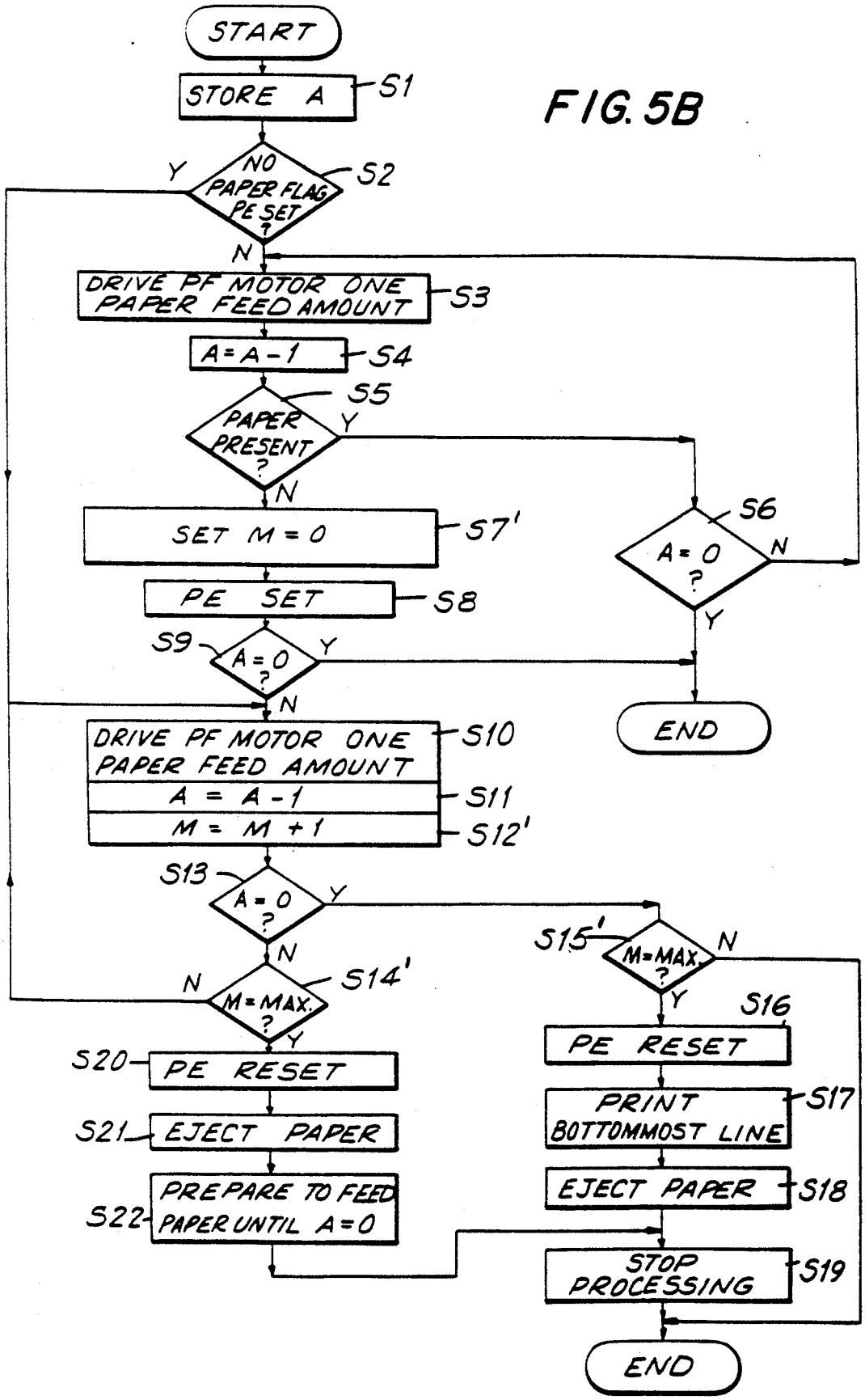

FIG. 5B illustrates an alternative embodiment of the invention in which a total executed paper feed amount M rather than remaining printable amount (LL) is checked after the absence of paper 29 is detected by paper detector 13. The routine shown in FIG. 5B is substantially the same as shown in FIG. 5A. Those steps in FIG. 5B which are the same as in FIG. 5A have been identified by the same reference indicia and will not be further described herein.

Under step S7' total paper feed amount M is set to a value of 0 when paper detector 13 first detects the absence of paper 29. Each time one additional line pitch of paper feeding is performed under step S10, the value of total paper feed amount M is incremented by 1 under step S12'. In this way, it becomes unnecessary to judge the remaining printable space on the paper after each additional line pitch of paper feeding. When total paper feed amount M reaches a maximum printable line count within the range of override amount L under step S14' or S15', no-paper flag PE is reset under step S20 or S16, respectively. Paper 29 is ejected from the printer and print control ends as discussed in connection with FIG. 5A.

In the foregoing embodiments, storage of non-executed paper feed amount A, remaining printable amount LL and total executed paper feeding amount M is provided by RAM 12 with CPU 9 incrementing (accumulating) and decrementing the values of LL and M as set forth in FIGS. 5A and 5B, respectively. Alternatively, counters can be used for storing and processing such values thereby enhancing the speed of the processing routine of printer 100 by decreasing the dependency on the software within CPU 9. The values of A, LL and M are preferably converted into the form of a line pitch count. Alternatively, these values can be converted into the form of a step count controlling the operation (movement) of PF motor 27.

Calculation of maximum printable line count LL under step S7 in FIG. 5A within override amount L (i.e., under the detected absence of paper 29) is based on override L, the paper rear edge marginal length and line pitch. When the line count and paper rear edge marginal length are at fixed values, calculation of the maximum printable line count LL becomes unnecessary. Storage of override amount L, the paper rear edge marginal length and the line pitch in ROM 11 or RAM 15 is also not required. Printer 100 also does not need to store and process the above values of paper rear edge marginal length and/or line pitch when host computer 5 is handling the same. Accordingly, override amount L can be used as the maximum printable line count.

It will thus be seen that the objects set forth above, among those made apparent from the preceding description are efficiently attained and, since certain changes may be made in carrying out the above method and in the construction set forth, without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed:

1. A method for controlling printing on that portion of a recording medium which remains to be advanced beyond a printing device by a feeding device of a printer when the absence of the recording medium is first detected by a detecting device, comprising:

determining whether the existence of a region within said remaining portion of the recording medium on which printable matter can be recorded exists based on the remaining portion to be advanced by the feeding device and on the length of the remaining printable area of said remaining portion, said length being in the direction of advancement of said recording medium;

storing a decremental value in a memory representing said region within said remaining portion of the recording medium on which printable matter can be recorded;

controlling the operation of a feeding device for advancing the recording medium toward the printing device;

controlling the operation of the printing device for printing the printable matter on the recording medium;

reducing the decremental value by a fixed amount corresponding to the distance by which said feeding device advances the remaining portion of the recording medium toward said printing device; and holding the decremental value in said storage device until said decremental values equals zero;

wherein control of the feeding device and printing device are based on the decremental value subsequent to the detected absence of the recording medium by the detecting device.

2. The method of claim 1, wherein the printing device includes a print head and a path along which said recording medium advances through the printer, said detecting device and print head being disposed relative to one another such that said recording medium advances past the detecting device prior to reaching said print head.

3. The method of claim 1, wherein reduction of the decremental value occurs each time said feeding device advances the remaining portion of the recording medium.

4. The method of claim 1, wherein based on the decremental value being zero, it is determined that no further printable matter can be recorded within said remaining portion of the recording medium.

5. The method of claim 3, wherein based on the decremental value being zero, it is determined that no further printable matter can be recorded within said remaining portion of the recording medium.

6. A method for controlling printing on that portion of a recording medium which remains to be advanced beyond a printing device by a feeding device of a printer when the absence of the recording medium is first detected by a detecting device, comprising:

determining whether the existence of a region within said remaining portion of the recording medium on which printable matter can be recorded exists based on the remaining portion to be advanced by the feeding device and on the length of the remaining printable area of said remaining portion, said length being in the direction of advancement of said recording medium;

storing an accumulated value representing said region within said remaining portion of the recording medium on which printable matter can be recorded;

controlling the operation of a feeding device for advancing the recording medium toward the printing device;

controlling the operation of the printing device for printing the printable matter on the recording medium; and increasing the accumulated value by a fixed amount corresponding to the distance by which said feeding device advances the remaining portion of the recording medium toward said printing device;

wherein control of the feeding device and printing device are based on the accumulated value subsequent to the detected absence of the recording medium by the detecting device.

7. The method of claim 6, wherein accumulation of the accumulated value occurs each time said feeding device advances the remaining portion of the recording medium.

8. The method of claim 7, wherein based on the accumulated value being equal to a maximum value, it is determined that no further printable matter can be recorded within said remaining portion of the recording medium.

9. A method for controlling printing on that portion of a recording medium which remains to be advanced beyond a printing device by a feeding device of a printer when the absence of the recording medium is first detected by a detecting device, comprising;

determining whether the existence of a region within said remaining portion of the recording medium on which printable matter can be recorded exists based on the remaining portion to be advanced by the feeding device and on the length of the remaining printable area of said remaining portion, said length being in the direction of advancement of said recording medium;

storing an accumulated value representing said region within said remaining portion of the recording medium on which printable matter can be recorded;

controlling the operation of a feeding device for advancing the recording medium toward the printing device; and controlling the operation of the printing device for printing the printable matter on the recording medium;

wherein control of the feeding device and printing device are based on the accumulated value subsequent to the detected absence of the recording medium by the detecting device and based on the accumulated value being equal to a maximum value, it is determined that no further printable matter can be recorded within said remaining portion of the recording medium.

10. A method for controlling printing on that portion of a recording medium which remains to be advanced beyond a printing device by a feeding device of a printer when the absence of the recording medium is first detected by a detecting device, comprising:

determining whether the existence of a region within said remaining portion of the recording medium on which printable matter can be recorded exists based on the remaining portion to be advanced by the feeding device and on the length of the remaining printable area of said remaining portion, said length being in the direction of advancement of said recording medium;

storing an accumulated value representing said region within said remaining portion of the recording medium on which printable matter can be recorded;

controlling the operation of a feeding device for advancing the recording medium toward the printing device; and controlling the operation of the printing device for printing the printable matter on the recording medium;

wherein control of the feeding device and printing device are based on the accumulated value subsequent to the detected absence of the recording medium by the detecting device.

* * * * *